US010925403B1

(12) United States Patent
Su

(10) Patent No.: US 10,925,403 B1
(45) Date of Patent: Feb. 23, 2021

(54) FOOT RING STRUCTURE FOR A CHAIR

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 0 days.

(21) Appl. No.: 16/596,865

(22) Filed: Oct. 9, 2019

(51) Int. Cl.
*A47C 7/50* (2006.01)
*A47C 7/00* (2006.01)

(52) U.S. Cl.
CPC ..... *A47C 7/5064* (2018.08); *A47C 7/004* (2013.01)

(58) Field of Classification Search
CPC ..... A47C 7/5064; A47C 7/004
See application file for complete search history.

(56) References Cited

U.S. PATENT DOCUMENTS 6,520,192 B1 * 2/2003 Lo ..... A45B 19/04 135/114
7,229,054 B2 * 6/2007 Hu ..... A47C 9/007 248/188.1
7,387,343 B1 * 6/2008 Hsieh ..... A47C 7/5064 297/423.38
8,297,563 B2 * 10/2012 Tsai ..... A47C 7/004 248/125.1
9,039,090 B2 * 5/2015 Pritchard ..... A47C 7/506 297/423.28
9,144,315 B1 * 9/2015 Cheng ..... A47C 7/506
9,220,346 B1 * 12/2015 Wu ..... A47C 7/5064
9,578,969 B1 2/2017 Su
9,706,849 B2 7/2017 Su
9,835,191 B1 * 12/2017 Chen ..... A47C 7/50
2007/0290541 A1 * 12/2007 Tsai ..... A47C 7/52 297/423.1

* cited by examiner

*Primary Examiner* — David R Dunn
*Assistant Examiner* — Tania Abraham

(57) ABSTRACT

A chair includes a seat, a post, a foot ring, a bushing and a positioning base. The post is connected to the seat. The foot ring has a ring body and a sleeve. The bushing is fastened in the sleeve and has a conic inner surface. The inner surface tapers upward. The inner surface has an inner thread. The positioning base is of a tubular shape and axially fastened onto the post. The positioning base has openings. Each opening is embedded by a braking block. An outer surface of each braking block has an outer thread. The outer surfaces of the braking blocks jointly form a conic shape corresponding to the inner surface of the bushing. The outer thread screws with the inner thread. The bushing presses the braking blocks to move toward the post to fasten the foot ring onto the post when the foot ring is rotated.

13 Claims, 10 Drawing Sheets

FOOT RING STRUCTURE FOR A CHAIR

TECHNICAL FIELD

The invention relates to chairs, particularly to a chair with a foot ring as a footrest.

RELATED ART

Some chairs are provided with a foot ring serving as a footrest. A foot ring must satisfy a user's demand to adjust its height position, so it has to be slidable and positioned on a post.

U.S. Pat. No. 9,578,969 and U.S. Pat. No. 9,706,849 teach an adjustable foot ring using a levered quick release device to implement sliding and positioning. Although such a levered quick release device provides excellent holding and convenience, its cost is too high. For those products which feature low cost, the levered quick release device cannot offer price competitiveness. Other adjustable fastening devices are needed.

Besides, U.S. Pat. No. 9,706,849 further adds claw plates integratedly connected to the inner sleeve. The holding force of the foot ring can be increased by pressing the claw plates to be deformed to press the post. Such a design effectively helps fastening the foot ring, but an end of the claw plate is connected to the inner sleeve. As a result, the deforming range and angle of the claw plates are limited and the holding force offered by them is incomplete. The claw plate only serves as an auxiliary but cannot replace a levered quick release device. In addition, when elastic fatigue occurs in the claw plate to malfunction, the whole inner sleeve must be replaced. This causes waste. The inner sleeve must be machined to provide a thread, so its cost cannot be effectively reduced.

SUMMARY OF THE INVENTION

An object of the invention is to provide a foot ring structure for a chair, which balances holding strength and cost without reducing operating convenience and is particularly suitable for those foot rings with low manufacturing cost.

Another object of the invention is to provide a foot ring structure for a chair, whose braking block is completely separate from the positioning base so as to make the braking block can be independently replaced. This can reduce maintenance cost.

To accomplish the above objects, the foot ring structure of the invention includes a seat, a post, a foot ring, a bushing and a positioning base. The post is vertically connected to a bottom of the seat. The foot ring has a ring body and a sleeve integratedly connected to the ring body. The bushing is axially fastened in the sleeve and is a tube having a conic inner surface. A diameter of the inner surface tapers upward. The inner surface is provided with an inner thread. The positioning base is of a tubular shape and is axially fastened onto the post. The positioning base has openings. Each opening is embedded by a movable braking block. An outer surface of each braking block is provided with an outer thread and slightly protrudes from the positioning base. The outer surfaces of the braking blocks jointly form a conic shape corresponding to the inner surface of the bushing. The outer thread screwing with the inner thread of the bushing. The bushing is moved with the foot ring. The bushing presses the braking blocks to move toward the post to fasten the foot ring onto the post when the foot ring is rotated toward a direction.

DETAILED DESCRIPTION OF THE INVENTION

Figure 1:
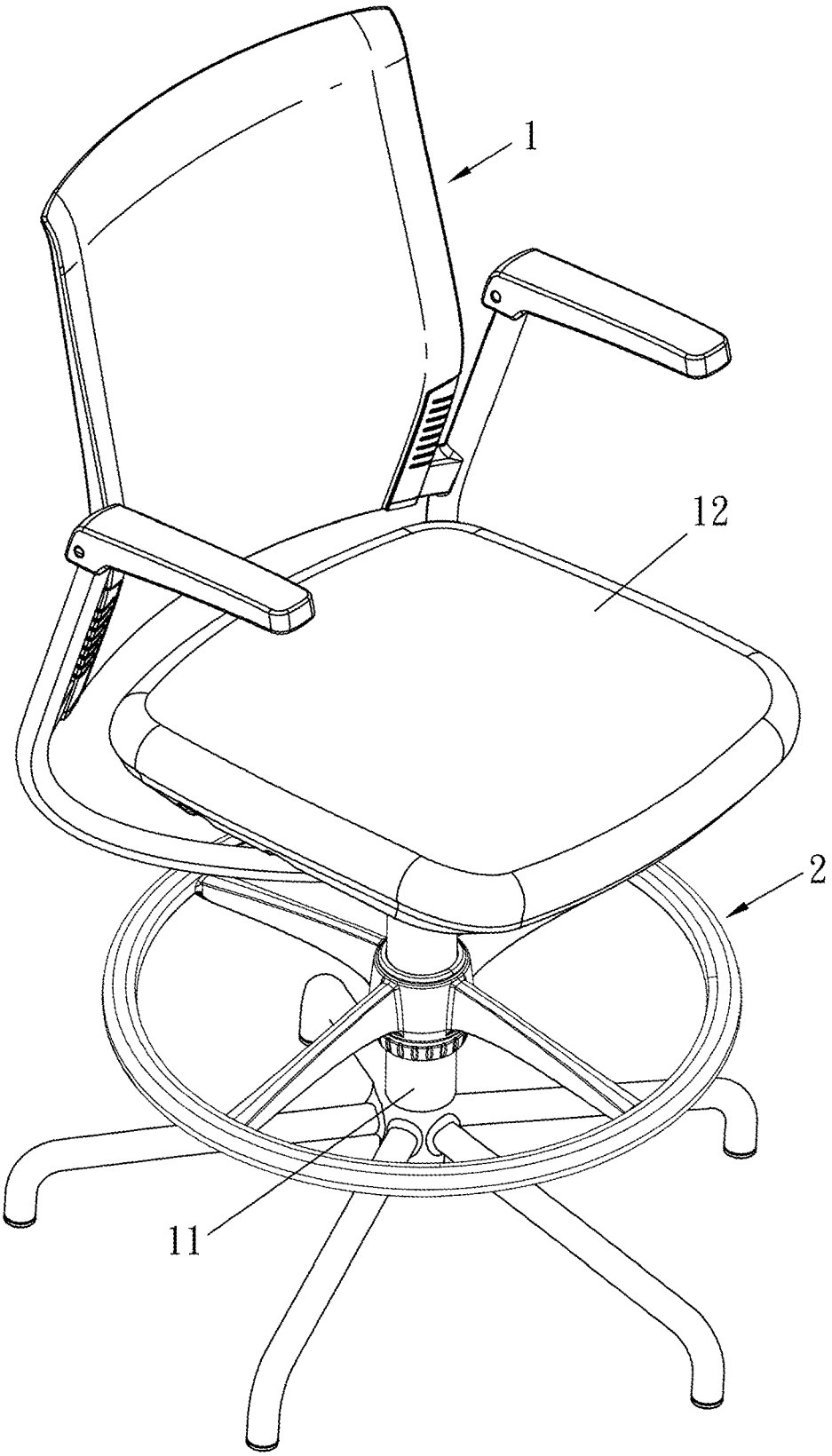
FIG. 1 is a schematic view of the invention assembled to a chair.

The "up", "upper", "lower" and "down" directions mentioned in the following description are based upon a chair in a normally usable status, i.e., a chair standing on a floor (a horizontal surface) as shown in FIG. 1. In other words, a seat 12 is substantially horizontal, the surface of the seat 12, which is sit by a user is upward, a direction which is opposite to the upward direction (toward the floor) is downward. The "inner" and "outer" directions are based upon the center of the chair 1. A direction toward or near the center is inner, and a direction away from the center is outer. The foot ring 2 of the invention is an annular body assembled onto a post 11 under the seat 12 to serve as a footrest.

Figure 2:
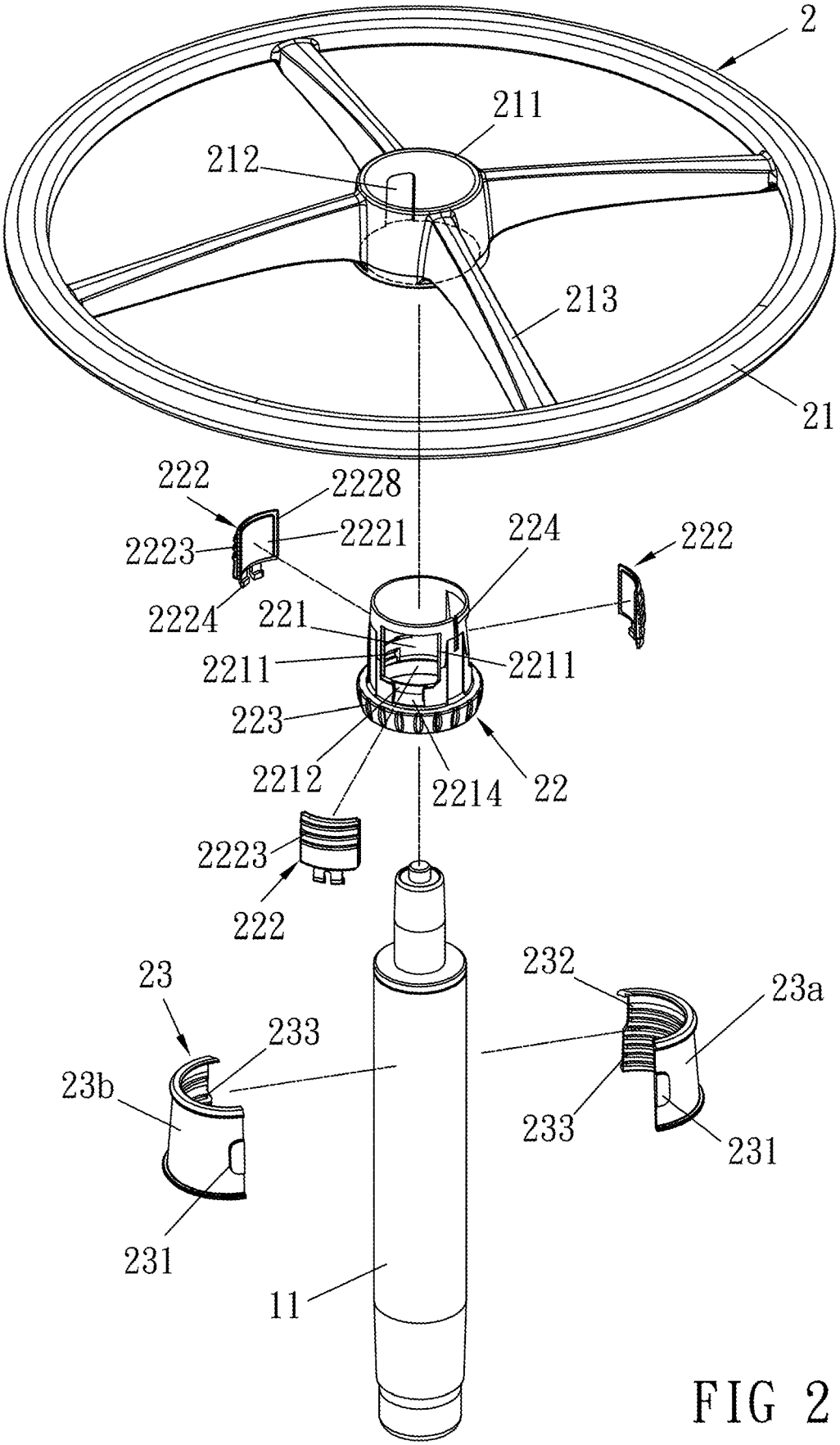
FIG. 2 is an exploded view of the invention.

Please refer to FIG. 2. The foot ring 2 includes a ring body 21, a sleeve 211 at the center of the ring body 21 and spokes 213 connected between the ring body 21 and the sleeve 211. An inner surface of the sleeve 211 is provided with an engaging recess 212. A bushing 23 is axially fastened in the sleeve 211 and attached onto the inner surface of the sleeve 211. In the shown embodiment, the bushing 23 is a cylindrical tube composed of two half tubes 23*a*, 23*b*, but not limited to this. The bushing 23 has a conic inner surface 232. A diameter of the inner surface 232 tapers upward. The inner surface 232 is provided with an inner thread 233. An outer surface of the bushing 23 is provided with an engaging protrusion 231. The engaging protrusion 231 is embedded into the engaging recess 212 for positioning. As a result, the bushing 23 can be engaged with and moved with the sleeve 211. A positioning base 22 being of a tubular shape is axially fastened onto the post 11. A lower end of the positioning base 22 is formed with a flange 223 for being held by a user. The positioning base 22 has openings 221. In this embodiment, the number of the openings 221 is three, but limited to this. Each opening 221 is embedded by a movable braking block 222. Inner surfaces of the braking blocks 222 are in contact with the post 11. Preferably, a slot 224 is formed between two adjacent openings 221 for absorbing deformation when the positioning base 22 is compressed.

Figure 3:
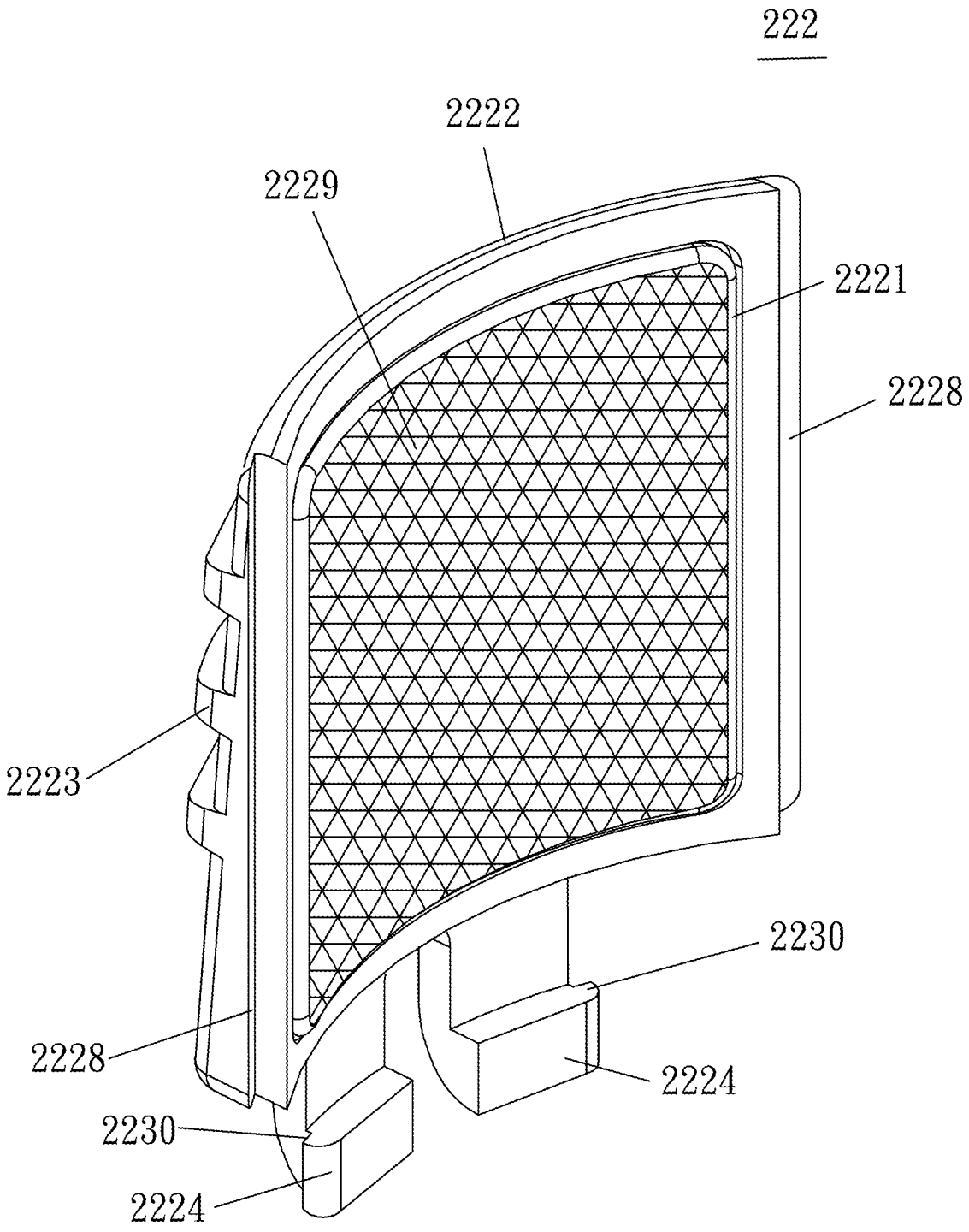
FIG. 3 is a perspective view of the braking block of the invention.
Figure 4:
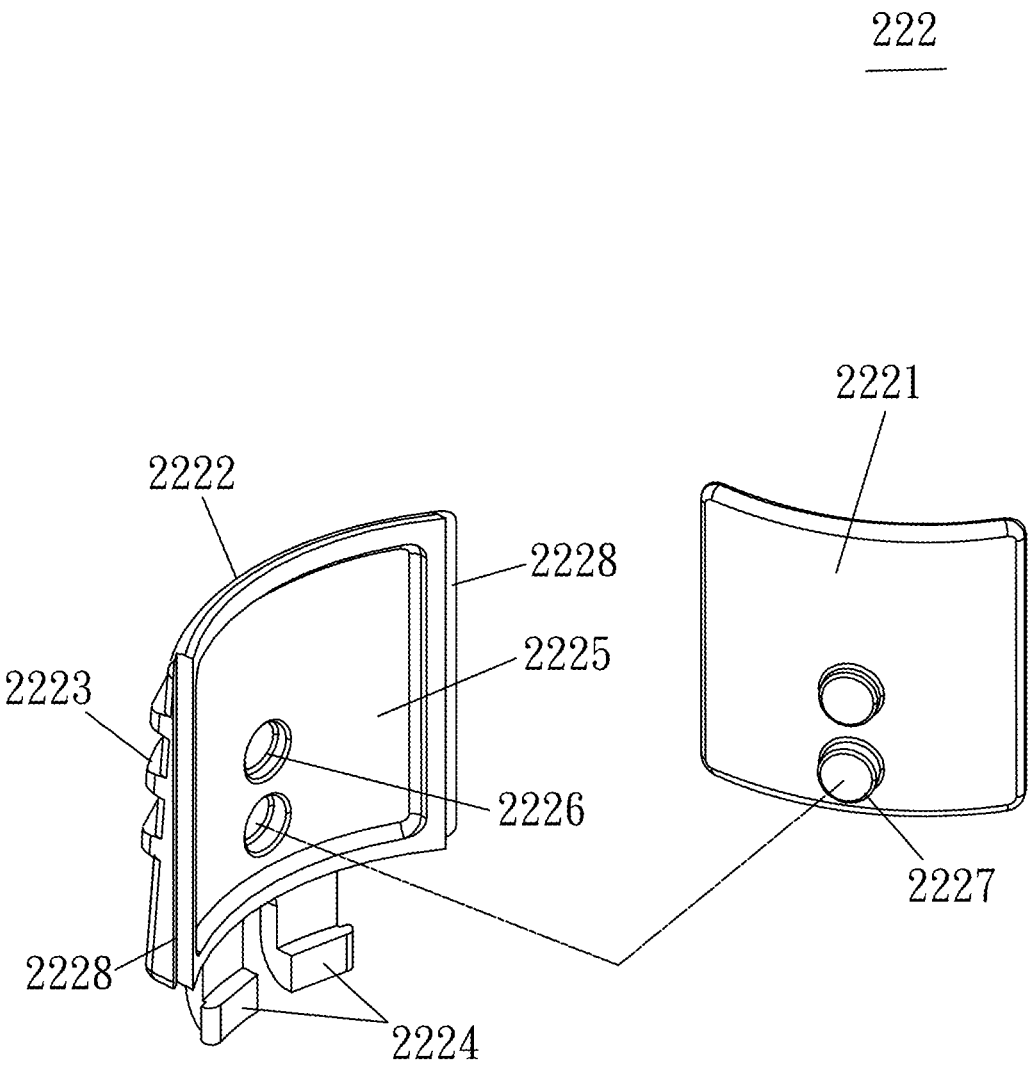
FIG. 4 is an exploded view of the braking block of the invention.

Please refer to FIGS. 3-7. The braking block 222 includes a body 2222 and a pad 2221. The body 2222 has a hollow 2225 for receiving the pad 2221. Preferably, an outer side of the pad 2221 is formed with one or two positioning protrusions 2227. The body 2222 is formed with positioning holes 2226 in the hollow 2225, which correspond to the positioning protrusions 2227. The positioning protrusions 2227 are embedded into the positioning holes 2226 to enhance the positioning effect between the pad 2221 and the body 2222. In addition, as shown in FIG. 3, an inner side of the pad 2221 is further provided with a rhomboid friction tread 2229 to improve brakeage against the post 11.

Figure 5:
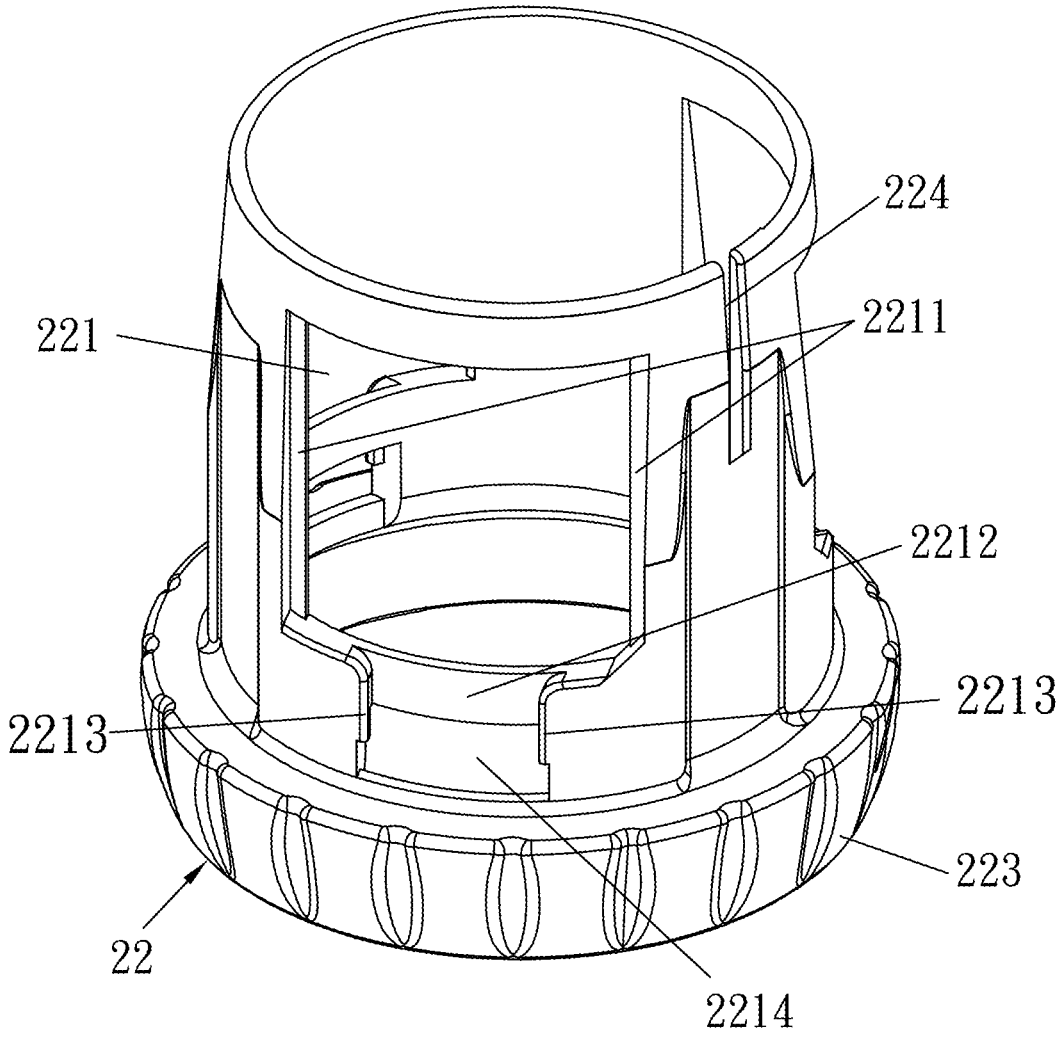
FIG. 5 is a perspective view of the positioning base of the invention.

A lower end of the body 2222 is extended with two hooks 2224 as shown in FIG. 3, but one hook 2224 is also available. Each of two opposite sides of the body 2222 is formed with a stepped edge 2228. Each of two opposite sides of each opening 221 is formed with a blocking edge 2211 corresponding to the stepped edge 2228 as shown in FIG. 5. The stepped edges 2228 are stopped by the blocking edges 2211 to prevent the braking block 222 from passing through the opening 221. In addition, an embedding hole 2214 is formed under the opening 221 for allowing the hooks 2224 to be embedded therein. A bridge 2212 is disposed between the embedding hole 2214 and the opening 221 for being hooked by the hooks 2224 so that the braking block 222 can be placed on the positioning base 22 to be advantageous to the subsequent assembling. Preferably, an outer side of the hook 2224 is formed with a protrudent stepped plate 2230. A side of the embedding hole 2214 is formed with a blocking sheet 2213 corresponding to the stepped plate 2230. The braking block 222 can be prevented from falling outward by the blocking sheet 2213 stopping the stepped plate 2230. That is, the braking block 222 is limited between the blocking edges 2211 and the blocking sheet 2213 without escaping from the positioning base 22 when the braking block 222 is assembled in the positioning base 22.

Figure 8:
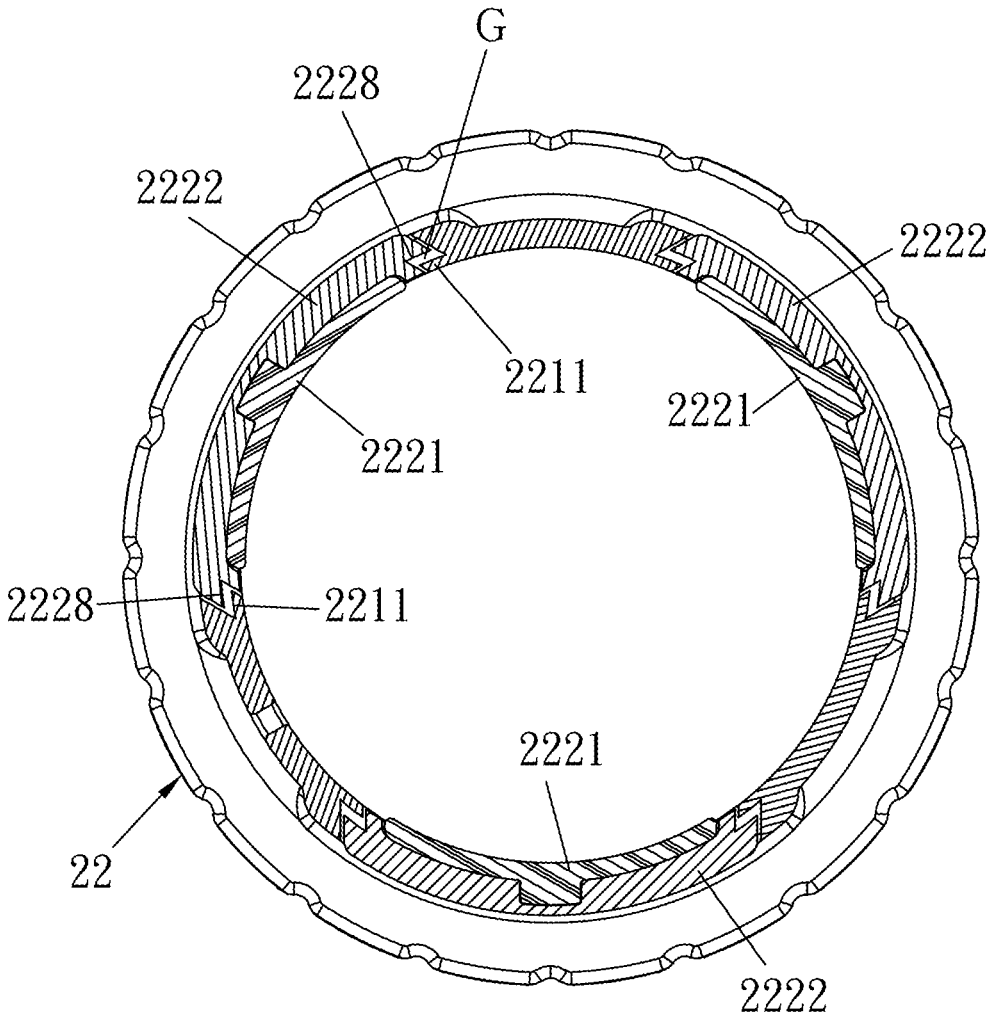
FIG. 8 is a transversal cross-section view of the positioning base of the invention.

Please refer to FIG. 8. The inner surfaces of the positioning base 22 and the pads 2221 form a cylindrical wall whose inner diameter is approximately identical to an outer diameter of the post 11. Inner surfaces of the pads 2221 slightly protrudes from an inner surface of the positioning base 22. A gap G is formed between the stepped edge 2228 and the blocking edge 2211 so that the braking blocks 222 will move toward the post 11 when the braking blocks 222 are pressed.

Figure 6:
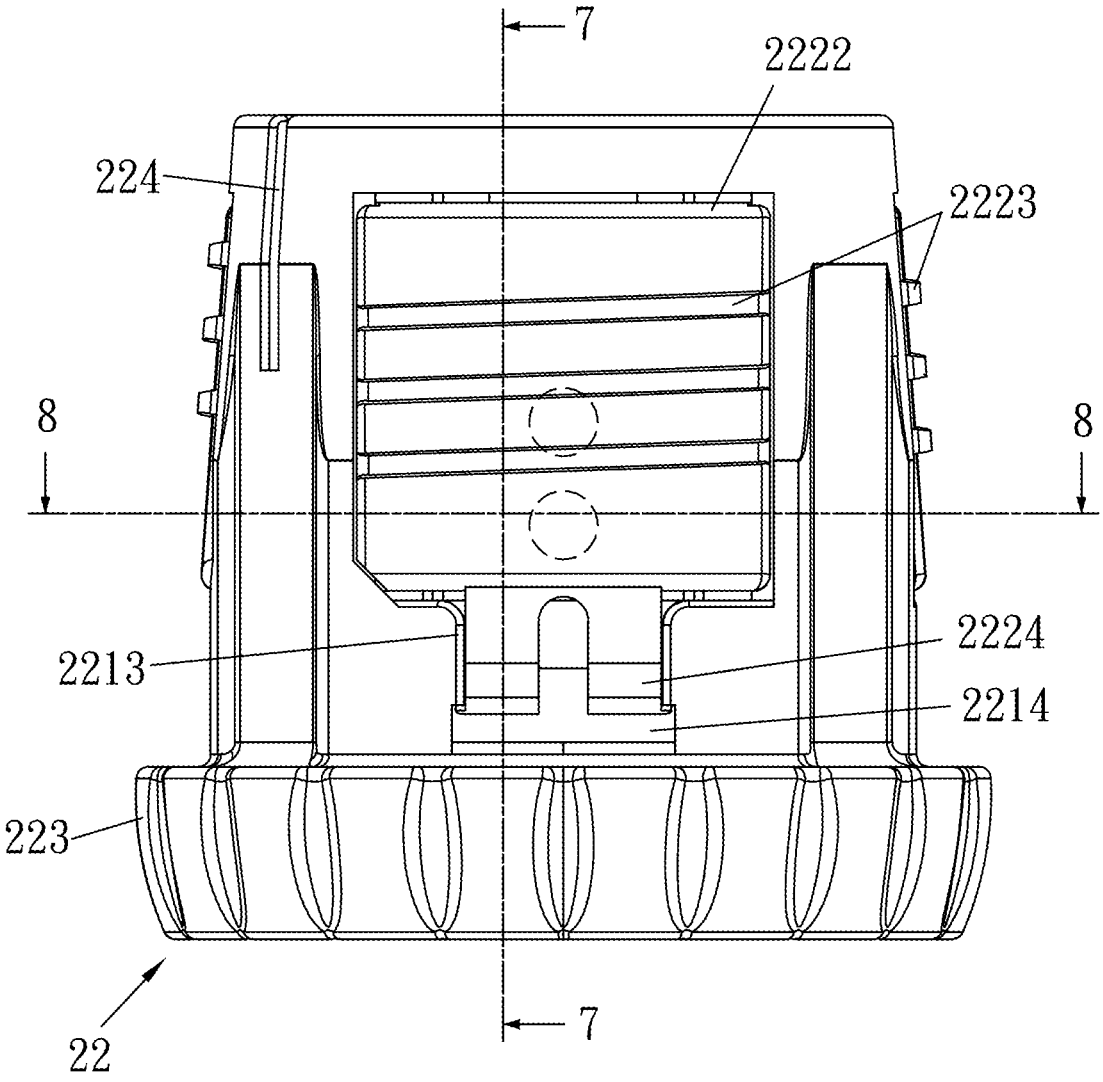
FIG. 6 is a side view of the positioning base of the invention.
Figure 7:
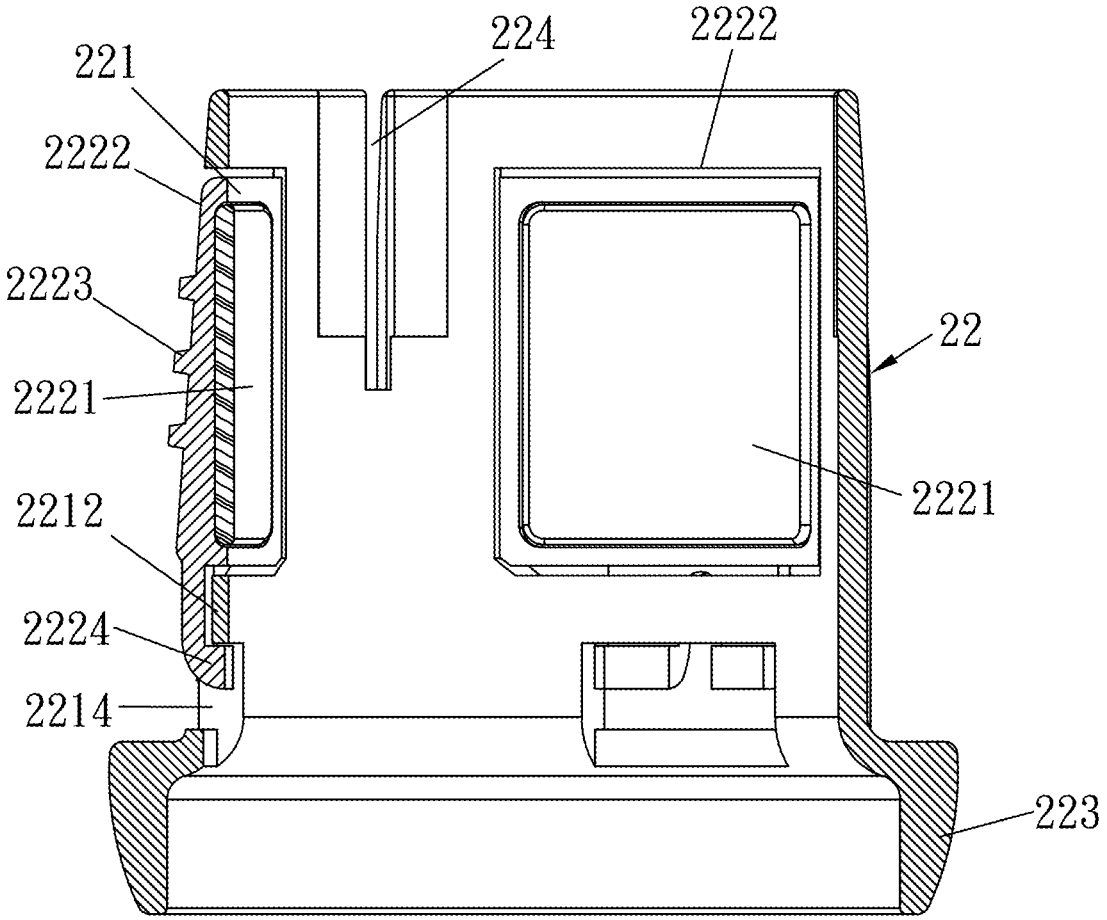
FIG. 7 is a longitudinal cross-section view of the positioning base of the invention.

Please refer to FIGS. 6 and 7. Outer surfaces of the braking blocks 222 slightly protrudes from the positioning base 22 and form a conic shape corresponding to the conic inner surface 232 of the bushing 23. Each of outer surfaces of the bodies 2222 of the braking blocks 222 is provided with an outer thread 2223 screwing with the inner thread 233 of the bushing 23 so that the braking blocks 222 are pushed to move toward the post 11 when the bushing 23 is rotated.

Figure 9:
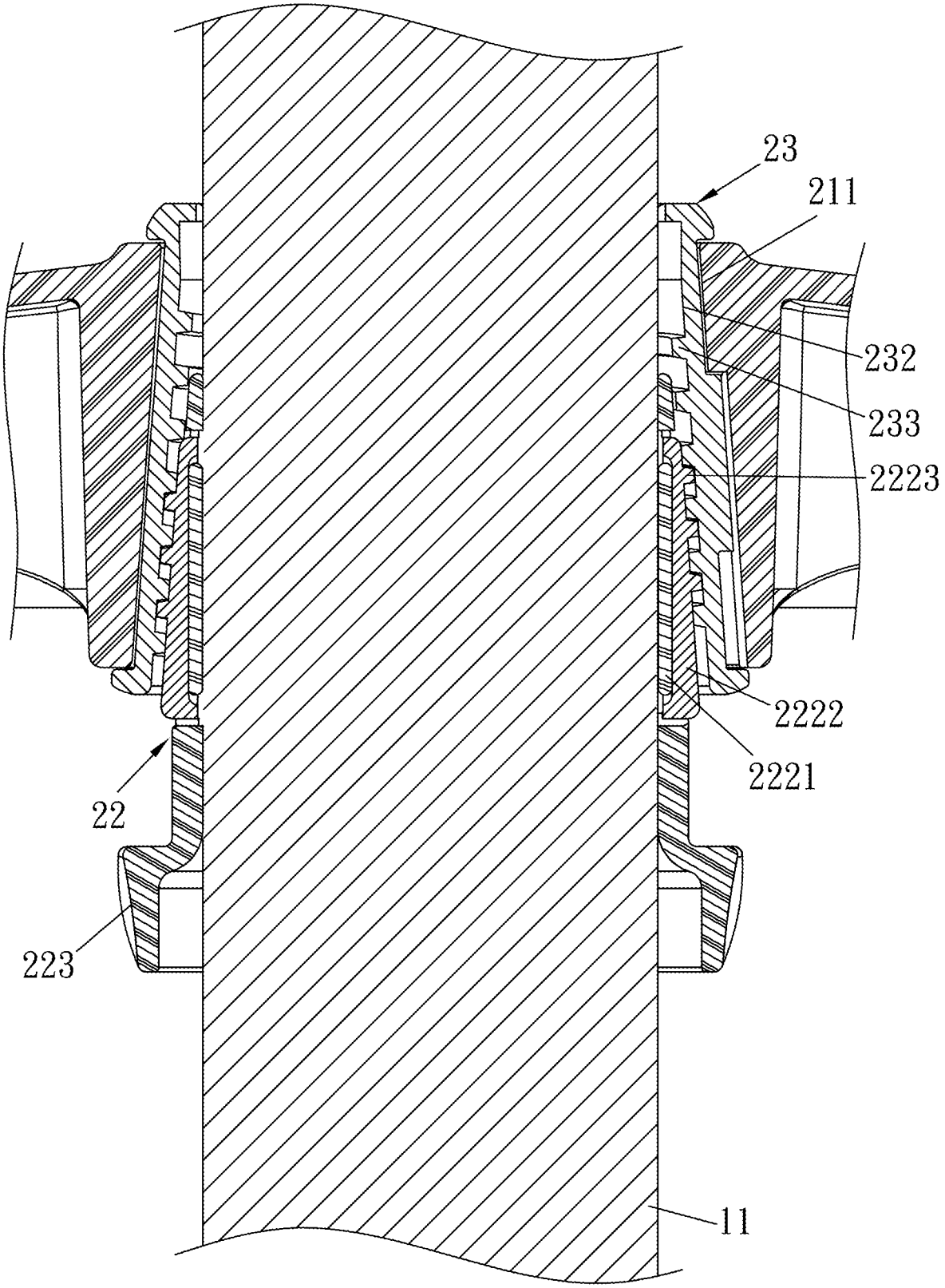
FIG. 9 is a cross-section view of the foot ring assembled on the post of the invention.
Figure 10:
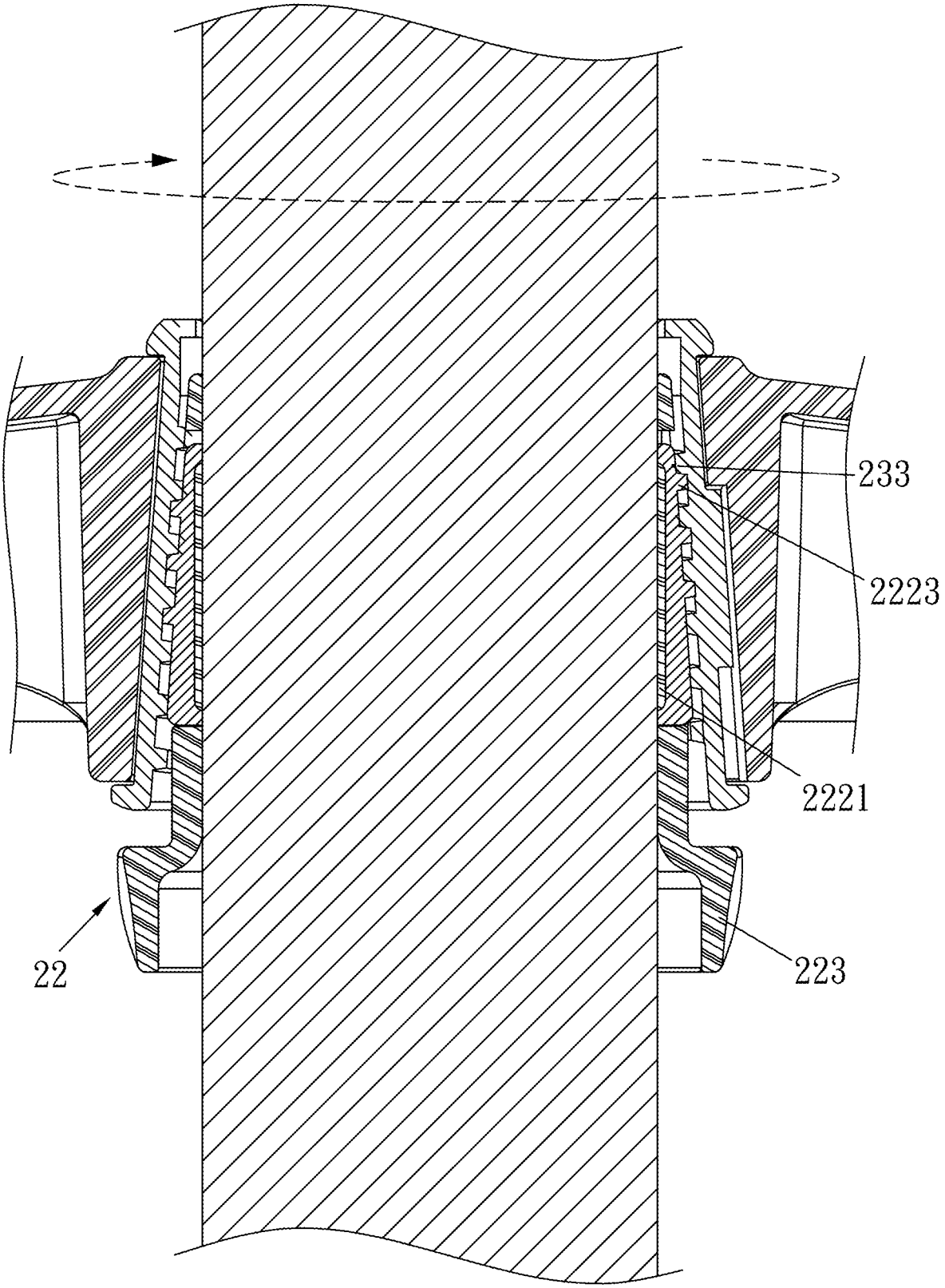
FIG. 10 is a cross-section view of the foot ring fastened on the post of the invention.

Please refer to FIGS. 9 and 10. When the foot ring 2 has been assembled to the post 11, the pads 2221 approach or are in contact with the post 11 while the foot ring 2 is still slidable on the post 11 as shown in FIG. 9.

When the height position of the foot ring 2 is determined by a user, as shown in FIG. 10, the user holds the flange 223 to fix the positioning base 22 and rotates the ring body 21 to drive the sleeve 211 and the bushing 23 in the sleeve 211 to screw the inner thread 233 of the bushing 23 with the outer threads 2223 of the braking blocks 222. Also, by the matching conic shapes of the outer surfaces of the braking blocks 222 and the inner surface 232 of the bushing 23, the braking blocks 222 is pressed by the bushing 23 to move toward the post 11 so that the pads 2221 press the post 11 to generate brakeage to fasten the foot ring 2 onto the post 11. On the contrary, when the foot ring 2 needs to adjust its position, reversely rotating the ring body 21 can release the pressure from the braking blocks 222 to the post 11 to restore to the free status as shown in FIG. 9.

What is claimed is:

1. A chair comprising:

a seat;

a post, vertically connected to a bottom of the seat;

a foot ring, having a ring body and a sleeve integratedly connected to the ring body;

a bushing, axially fastened in the sleeve, being a tube having a conic inner surface, a diameter of the inner surface tapering upward, and the inner surface being provided with an inner thread; and a positioning base, being of a tubular shape, axially fastened onto the post, having openings, each opening being embedded by a movable braking block, an outer surface of each braking block being provided with an outer thread and slightly protruding from the positioning base, the outer surfaces of the braking blocks jointly forming a conic shape corresponding to the inner surface of the bushing, and the outer thread screwing with the inner thread of the bushing;

wherein the bushing is moved with the foot ring, and the bushing presses the braking blocks to move toward the post to fasten the foot ring onto the post when the foot ring is rotated toward a direction.

2. The chair of claim 1, wherein each braking block comprises a body and a pad.

3. The chair of claim 2, wherein an inner side of the pad is further provided with a friction tread.

4. The chair of claim 3, wherein the friction tread is of a rhomboid shape.

5. The chair of claim 2, wherein the body has a hollow for receiving the pad, an outer side of the pad is formed with a positioning protrusion, the body is formed with a positioning hole in the hollow, which corresponds to the positioning protrusion, and the positioning protrusion is embedded into the positioning hole.

6. The chair of claim 2, wherein each of two opposite sides of the braking block body is formed with a stepped edge, each of two opposite sides of each opening is formed with a blocking edge corresponding to the stepped edge, and the stepped edges are stopped by the blocking edges.

7. The chair of claim 6, wherein a gap is formed between the stepped edge and the blocking edge.

8. The chair of claim 2, wherein a lower end of the braking block body is extended with a hook, an embedding hole is formed under the opening for allowing the hook to be embedded therein, and a bridge is disposed between the embedding hole and the opening for being hooked by the hooks.

9. The chair of claim 8, wherein an outer side of the hook is formed with a protrudent stepped plate, a side of the embedding hole is formed with a blocking sheet corresponding to the stepped plate, and the blocking sheet stops the stepped plate.

10. The chair of claim 2, wherein inner surfaces of the pads slightly protrudes from an inner surface of the positioning base.

11. The chair of claim 1, wherein an inner surface of the sleeve is provided with an engaging recess, an outer surface of the bushing is provided with an engaging protrusion, and the engaging protrusion is embedded into the engaging recess for positioning.

12. The chair of claim 1, wherein a lower end of the positioning base is formed with a flange.

13. The chair of claim 1, wherein a slot is formed between two adjacent openings.

* * * * *